US008419473B1

(12) United States Patent
Lan et al.

(10) Patent No.: US 8,419,473 B1
(45) Date of Patent: Apr. 16, 2013

(54) ELECTRICAL CONNECTOR

(75) Inventors: Rong-Qin Lan, New Taipei (TW); Li-Jun Xu, New Taipei (TW); Ming-Han Lin, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 1 day.

(21) Appl. No.: 13/344,610

(22) Filed: Jan. 5, 2012

(51) Int. Cl.
*H01R 13/648* (2006.01)

(52) U.S. Cl.
USPC ..... 439/607.17; 439/660

(58) Field of Classification Search ..... 439/607.01, 439/607.17, 607.19, 660
See application file for complete search history.

(56) References Cited

U.S. PATENT DOCUMENTS 4,955,827 A * 9/1990 Roy et al. ..... 439/595
5,395,252 A * 3/1995 White ..... 439/66
7,645,194 B2 * 1/2010 Van Luchene et al. ..... 463/25
7,946,893 B2 * 5/2011 Chen et al. ..... 439/660
8,210,870 B2 * 7/2012 Phillips et al. ..... 439/546
8,246,395 B2 * 8/2012 Vino et al. ..... 439/884
2009/0088025 A1 * 4/2009 Lin et al. ..... 439/607
2009/0325417 A1 * 12/2009 Ko ..... 439/350
2010/0233907 A1 * 9/2010 Wu ..... 439/607.58
2012/0052713 A1 * 3/2012 Yang et al. ..... 439/353

* cited by examiner

*Primary Examiner* — Gary F. Paumen
(74) *Attorney, Agent, or Firm* — Lin & Associates IP, Inc.

(57) ABSTRACT

An electrical connector includes an insulating housing defining a plurality of terminal grooves each extending along a front-to-rear direction. A plurality of terminals includes a plurality of flat terminals made by stamping and bending metal strips and a plurality of spring terminals made by die-cutting upright metal boards of long rectangular shape. Each spring terminal is inserted forward and uprightly positioned in the corresponding terminal groove of the insulating housing without being pressed and bent. The flat terminals are molded in the insulating housing with front ends thereof acted as contacting ends and exposed outside. A lid is mounted to a back of the insulating housing for positioning a rear of the spring terminal. A latch is inserted forward in the insulating housing. A shielding shell is mounted to the insulating housing and electrically connects with the latch.

8 Claims, 3 Drawing Sheets

ELECTRICAL CONNECTOR

BACKGROUND OF THE INVENTION

1. Field of the Invention

The present invention relates to an electrical connector, and particularly to an electrical connector capable of avoiding terminals curling when the electrical connector is connected with a mated connector.

2. The Related Art

At present, electrical connectors are used as main connecting components for telecommunication in all kinds of electronic products. The electrical connector generally includes an insulating housing, a plurality of terminals assembled in the insulating housing, and a metal shell enclosing the insulating housing. However, the terminals are often made by stamping and bending a metal plate. As a result, in the process of inserting a mated connector into the electrical connector, the terminals are apt to have an elastic deformation and cause a poor connection with the mated connector, and further shorten the using life of the electrical connector.

SUMMARY OF THE INVENTION

An object of the present invention is to provide an electrical connector. The electrical connector includes an insulating housing having a base body and a tongue portion protruded forwards from a substantial middle of a front of the base body. A top of the tongue portion defines a mating groove penetrating through a front of the tongue portion. A bottom inner side of the mating groove defines a plurality of terminal grooves each extending along a front-to-rear direction to penetrate through the base body. Two sides of a bottom of the tongue portion protrude downward and further extend forward beyond the front of the tongue portion to form a pair of bearing boards. A plurality of terminals includes a plurality of flat terminals made by stamping and bending metal strips and a plurality of spring terminals made by die-cutting upright metal boards of long rectangular shape. Each spring terminal is inserted forward and uprightly positioned in the corresponding terminal groove of the insulating housing without being pressed and bent. The spring terminal has a contacting portion protruding into the mating groove. The flat terminals are molded in the base body and the bearing boards of the tongue portion with front ends thereof acted as contacting ends and exposed through tops of fronts of the bearing boards. A lid is mounted to a back of the insulating housing and defines a plurality of inserting holes each aligned with one terminal groove for positioning a rear of the spring terminal therein. A latch is inserted forward in the insulating housing. A shielding shell is curved from a metal plate to show a hollow barrel shape and sheathes the tongue portion and the bearing boards of the insulating housing, wherein the shielding shell electrically connects with the latch.

As described above, the spring terminals are made by die-cutting upright metal boards of long rectangular shape, and then are inserted forward and uprightly positioned in the corresponding terminal grooves of the insulating housing without being pressed and bent, so the spring terminals have good mechanical property and can effectively avoid elastic deformation thereof when the electrical connector is connected with a mated connector.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
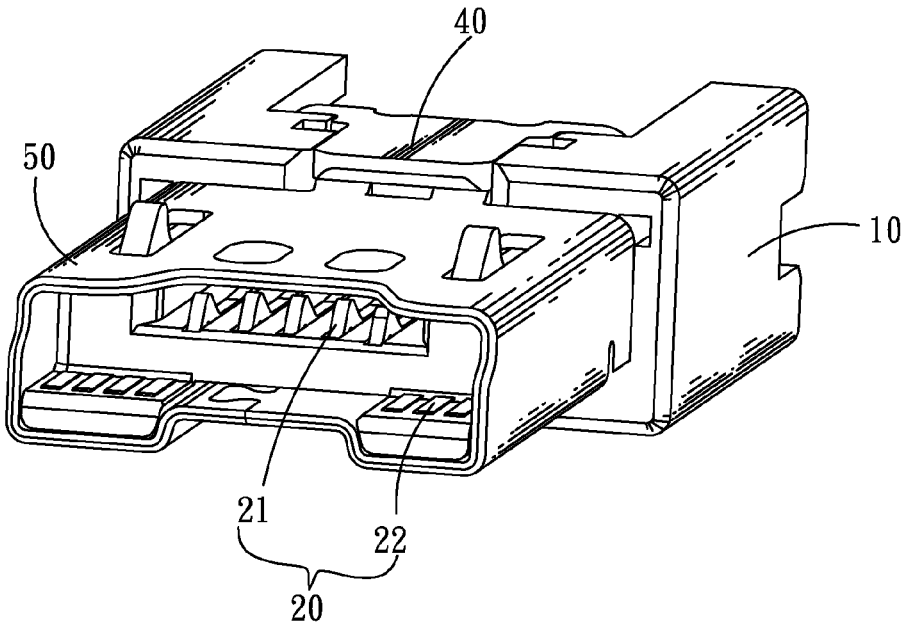
FIG. 1 is an assembled perspective view of an electrical connector in accordance with the present invention.
Figure 2:
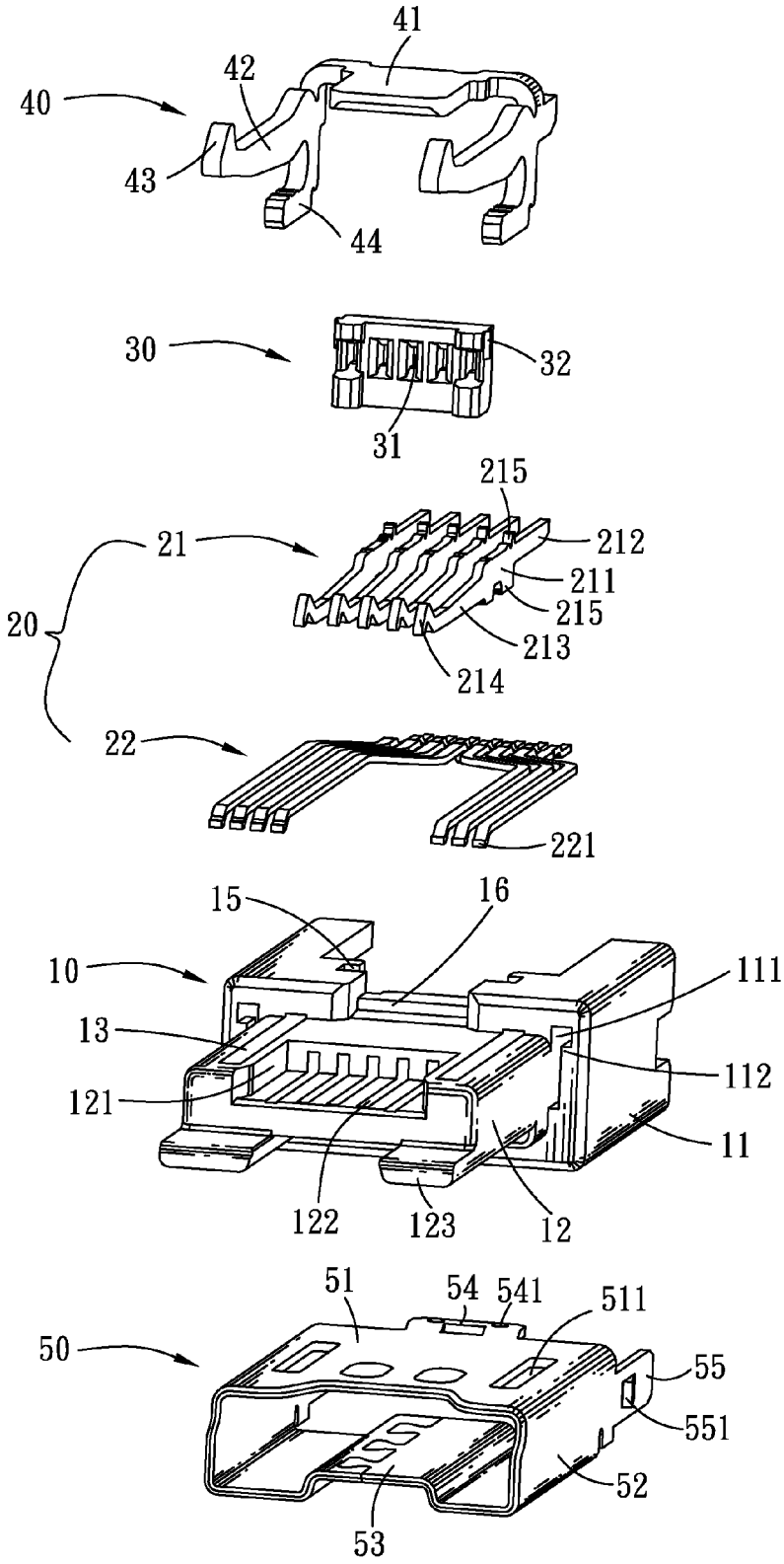
FIG. 2 is an exploded perspective view of the electrical connector shown in FIG. 1.

Referring to FIGS. 1-2, an electrical connector according to an embodiment of the present invention includes an insulating housing 10, a plurality of terminals 20, a lid 30, a latch 40 and a shielding shell 50.

Figure 3:
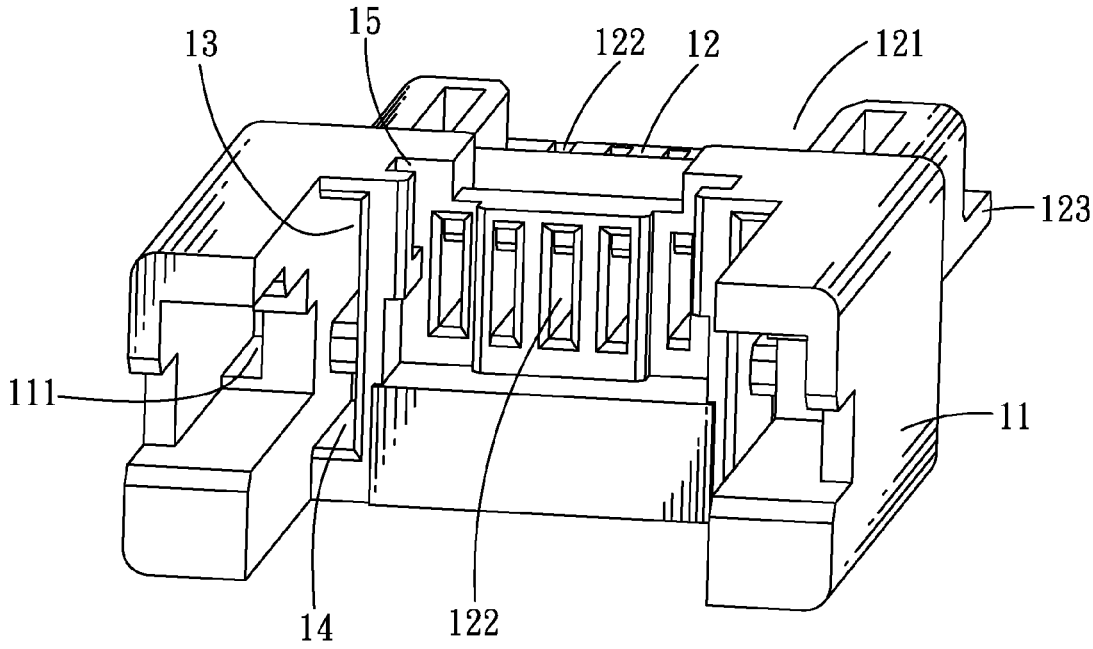
FIG. 3 is a perspective view of an insulating housing of the electrical connector shown in FIG. 2.

With reference to FIG. 2 and FIG. 3, the insulating housing 10 has a base body 11 and a tongue portion 12 protruded forwards from a substantial middle of a front of the base body 11. The base body 11 defines a pair of fastening cavities 111 adjacent to two opposite sides of the tongue portion 12 and each extending along a front-to-rear direction to penetrate through the base body 11. Two outmost inner sides of the fastening cavities 111 protrude inward to form a pair of holding blocks 112 at front ends thereof. A back of the base body 11 defines a pair of inserting slots 13 located beside two outmost terminal grooves 122 and each further extending forward into the tongue portion 12. The inserting slots 13 penetrate through a top of the tongue portion 12. The back of the base body 11 further defines a pair of inserting fillisters 14 located under the inserting slots 13 respectively. A substantial middle of a top of the base body 11 defines a locking groove 16 penetrating through the base body 11 along the front-to-rear direction. The top of the tongue portion 12 defines a mating groove 121 penetrating through a front of the tongue portion 12. A bottom inner side of the mating groove 121 defines a plurality of terminal grooves 122 each extending along a front-to-rear direction to penetrate through the base body 11. Two sides of a bottom of the tongue portion 12 protrude downward and further extend forward beyond the front of the tongue portion 12 to form a pair of bearing boards 123.

Referring to FIG. 2, the terminals 20 include a plurality of flat terminals 22 made by stamping and bending metal strips and a plurality of spring terminals 21 made by die-cutting upright metal boards of long rectangular shape. Each spring terminal 21 is inserted forward and uprightly positioned in the corresponding terminal groove 122 of the insulating housing 10 without being pressed and bent. Each of the spring terminals 21 has an upright board-shaped fastening portion 211 fixed in a rear of the corresponding terminal groove 122. A rear end of the fastening portion 211 extends rearward to form a soldering portion 212 projecting rearward out of the terminal groove 122. A front end of the fastening portion 211 extends forward to form a spring arm 213 located in a front of the terminal groove 122. A front end of the spring arm 213 is die-cut to form a contacting portion 214 protruding upward beyond a horizontal plane of the spring arm 213 and into the mating groove 121. Top and bottom edges of the fastening portion 211 are die-cut to form locking portions 215 snapped in inner sides of the rear of the corresponding terminal groove 122 to secure the spring terminal 21 in the terminal groove 122. The flat terminals 22 are molded in the base body 11 and the bearing boards 123 of the tongue portion 12, with front ends thereof acted as contacting ends 221 and exposed through tops of fronts of the bearing boards 123.

The lid 30 is adapted for being mounted to the back of the base body 11 of the insulating housing 10. The lid 30 defines a plurality of inserting holes 31 each aligned with one terminal groove 122 for positioning the soldering portion 212 of the corresponding spring terminal 21 therein, wherein the soldering portions 212 pass through the inserting holes 31 to further stretch out behind the lid 30. Two opposite side faces of the lid 30 protrude outward to form a pair of stopping blocks 32. The base body 11 of the insulating housing 10 correspondingly defines two blocking grooves 15 for buckling the stopping blocks 32 therein so as to secure the lid 30 and the insulating housing 10 together.

In FIG. 2, the latch 40 has a covering board 41 of which two opposite sides of a rear end bend downward and then extend forward to form two elastic arms 42. The elastic arm 42 slightly inclines upward and a free end thereof protrudes upward to form a locking barb 43. A rear end of the elastic arm 42 protrudes downward and then extends forward to form a positioning portion 44. The shielding shell 50 is curved from a metal plate to show a hollow barrel shape, and has a top plate 51 defining a pair of open slots 511, two side plates 52 extending downward from two opposite side edges of the top plate 51, and two bottom plates 53 curvedly extending towards each other to be wedged together. A middle of a rear edge of the top plate 51 protrudes rearward to form a buckling slice 54 with at least one bump 541 protruding thereon. Each of the side plates 52 of the shielding shell 50 is elongated rearwards to form a clamping arm 55 with a wedge 551 protruding outward thereon.

Referring to FIGS. 1-3, the shielding shell 50 sheaths the tongue portion 12 and the bearing boards 123 of the insulating housing 10, with the open slots 511 corresponding to the inserting slots 13. The clamping arm 55 is inserted rearward into the corresponding fastening cavity 111, and the wedge 551 is stopped behind the holding block 112 of the insulating housing 10. The buckling slice 54 is positioned in the locking groove 16 of the insulating housing 10. The latch 40 is inserted forward in the insulating housing 10 by means of inserting the elastic arms 42 forward in the corresponding inserting slots 13 and inserting the positioning portions 44 in the corresponding inserting fillisters 14. The locking barb 43 elastically projects upward out of the inserting slot 13 and the open slot 511. The covering board 41 is positioned in the locking groove 16 and attached on the buckling slice 54 with the bump 541 electrically interfering with a bottom side of the covering board 41.

As described above, the spring terminals 21 are made by die-cutting upright metal boards of long rectangular shape, and then are inserted forward and uprightly positioned in the corresponding terminal grooves 122 of the insulating housing 10 without being pressed and bent, so the spring terminals 21 have good mechanical property and can effectively avoid elastic deformation of the spring arms 213 when the electrical connector is connected with a mated connector.

What is claimed is:

1. An electrical connector, comprising:

an insulating housing having a base body and a tongue portion protruded forwards from a substantial middle of a front of the base body, a top of the tongue portion defining a mating groove penetrating through a front of the tongue portion, a bottom inner side of the mating groove defining a plurality of terminal grooves each extending along a front-to-rear direction to penetrate through the base body, two sides of a bottom of the tongue portion protruding downward and further extending forward beyond the front of the tongue portion to form a pair of bearing boards;

a plurality of terminals including a plurality of flat terminals made by stamping and bending metal strips and a plurality of spring terminals made by die-cutting upright metal boards of long rectangular shape, each spring terminal being inserted forward and uprightly positioned in the corresponding terminal groove of the insulating housing without being pressed and bent, the spring terminal having a contacting portion protruding into the mating groove, the flat terminals being molded in the base body and the bearing boards of the tongue portion with front ends thereof acted as contacting ends and exposed through tops of fronts of the bearing boards;

a lid mounted to a back of the insulating housing and defining a plurality of inserting holes each aligned with one terminal groove for positioning a rear of the spring terminal therein;

a latch inserted forward in the insulating housing; and a shielding shell curved from a metal plate to show a hollow barrel shape and sheathing the tongue portion and the bearing boards of the insulating housing, the shielding shell electrically connecting with the latch.

2. The electrical connector as claimed in claim 1, wherein each of the spring terminals has an upright board-shaped fastening portion fixed in a rear of the corresponding terminal groove, a rear end of the fastening portion extends rearward to form a soldering portion passing through the inserting hole of the lid to stretch out behind the lid, a front end of the fastening portion extends forward to form a spring arm located in a front of the terminal groove, a front end of the spring arm is die-cut to form the contacting portion protruding upward beyond a horizontal plane of the spring arm.

3. The electrical connector as claimed in claim 2, wherein top and bottom edges of the fastening portion are die-cut to form locking portions snapped in inner sides of the rear of the corresponding terminal groove to secure the spring terminal in the terminal groove.

4. The electrical connector as claimed in claim 1, wherein two opposite side faces of the lid protrude outward to form a pair of stopping blocks, the base body of the insulating housing correspondingly defines two blocking grooves for buckling the stopping blocks therein so as to secure the lid and the insulating housing together.

5. The electrical connector as claimed in claim 1, wherein a substantial middle of a top of the base body defines a locking groove penetrating through the base body along a front-to-rear direction, the back of the base body defines a pair of inserting slots located beside two outmost terminal grooves and each further extending forward into the tongue portion, the inserting slots penetrate through the top of the tongue portion, the shielding shell has a top plate defining a pair of open slots corresponding to the inserting slots, two side plates extending downward from two opposite side edges of the top plate, and two bottom plates curvedly extending towards each other to be wedged together, a middle of a rear edge of the top plate protrudes rearward to form a buckling slice positioned in the locking groove, the latch has a covering board of which two sides of a rear end bend downward and then extend forward to form two elastic arms inserted forward in the corresponding inserting slots, the elastic arm slightly inclines upward and a free end thereof protrudes upward to form a locking barb elastically projecting upward out of the inserting slot and the open slot, the covering board is positioned in the locking groove and attached on the buckling slice.

6. The electrical connector as claimed in claim 5, wherein at least one bump protrudes on the buckling slice of the shielding shell for electrically interfering with a bottom side of the covering board of the latch.

7. The electrical connector as claimed in claim 5, wherein the back of the base body further defines a pair of inserting fillisters located under the inserting slots respectively, a rear end of the elastic arm protrudes downward and then extends forward to form a positioning portion inserted in the corresponding inserting fillister.

8. The electrical connector as claimed in claim 5, wherein the base body of the insulating housing defines a pair of fastening cavities adjacent to two opposite sides of the tongue portion and each extending along a front-to-rear direction to penetrate through the base body, two outmost inner sides of the fastening cavities protrude inward to form a pair of holding blocks at front ends thereof, each of the side plates of the shielding shell is elongated rearwards to form a clamping arm with a wedge protruding outward thereon, the clamping arm is inserted into the corresponding fastening cavity, and the wedge is stopped behind the holding block.

* * * * *